United States Patent [19]

Anthonsen et al.

[11] Patent Number: 4,663,236

[45] Date of Patent: May 5, 1987

[54] COATED PHOTOGRAPHIC BASE MATERIAL

[75] Inventors: Reiner Anthonsen, Bramsche; Ferencz Kertész, Bissendorf; Heinz Trentmann, Osnabrück; Wieland Sack, Bissendorf, all of Fed. Rep. of Germany

[73] Assignee: Felix Schoeller Jr. GmbH & Co., KG, Osnabruck, Fed. Rep. of Germany

[21] Appl. No.: 722,732

[22] Filed: Apr. 11, 1985

[30] Foreign Application Priority Data

Apr. 21, 1984 [DE] Fed. Rep. of Germany ..... 3415215

[51] Int. Cl.[4] ..... G03C 1/80; G03C 1/87; G03C 1/76

[52] U.S. Cl. ..... 428/482; 428/500; 428/521; 428/522; 430/532; 430/533; 430/536

[58] Field of Search ..... 430/532, 536, 533; 428/521, 522, 500, 482

[56] References Cited

U.S. PATENT DOCUMENTS 4,384,040 5/1983 von Meer ..... 430/532

*Primary Examiner*—Richard L. Schilling

*Attorney, Agent, or Firm*—Lockwood, Alex, Fitzgibbon & Cummings

[57] ABSTRACT

Photographic base materials are described which contain on at least one side thereof a coating whose binder component is produced predominantly from unsaturated compounds and which has been hardened by means of energy supplying radiation. Discoloration in connection with wet developing is avoided by including within the coating material, before hardening thereof, at least one unsaturated monomeric, oligomeric or polymeric hydroxyfunctional substance and by maintaining the molal concentration of the hydroxyl groups at a value of at least 2. The coating material as defined in the invention is suited for use as a base for photographic layers which are developed wet, as well as for those which are developed dry.

24 Claims, No Drawings

COATED PHOTOGRAPHIC BASE MATERIAL

BACKGROUND OF THE INVENTION

The present invention relates to a photographic base material which contains a coating on at least one side, which coating includes a binder component that is produced predominantly from unsaturated compounds and that has been hardened by means of energy supplying radiation. The invention relates especially to a base material for photographic layers that can be used for dry developing processes as well as for wet developing processes.

A multitude of base materials for photographic coatings are known. The most widely used bases include film materials and paper. As a rule, papers are additionally coated. Waterproof papers coated with synthetic resin layers have been widely used as bases for photographic coatings. Films of synthetic resin coated with special layers and laminates also are known. Most widely used are papers that are coated on both sides with polyolefin resin and film materials coated with pigmented layers, such being described, for example, in DE-AS No. 14 47 815, U.S. Pat. Nos. 3,833,380, 3,630,742, 3,928,037.

Especially advanced paper bases which consist of base paper with at least one coating produced in situ by means of electron radiation hardening are described in DE-OS No. 30 22 451 and DE-OS No. 30 22 709. The advantages of a coating hardened with electron radiation are its resistance to marring, its great ability to take on pigments, and its enhanced surface smoothness when compared with polyolefin coatings.

Coatings of synthetic resin are resistant not only to water but also to acid and alkaline photographic process solutions to thereby prevent the penetration of these solutions into paper supports that may be lying thereunder. Consequently, for paper or a mat base, the time-consuming washing process is significantly shortened. However, the widely used synthetic resin coatings consisting of polyolefins are generally less stable with respect to the effect of heat thereon because the coating material is thermoplastic.

All resin coatings, whether they are on paper or on film, can contain pigments, coloring substances, optical brighteners, picture stabilizers, antioxidants or other additives to the extent that they are desirable or necessary in view of the desired characteristics of the photographic picture to be present on them. Of these types of possible additives, pigments and coloring substances have the greatest importance for the visual impression of a photographic picture present on the coating. For color pictures, for example, they determine the color character and are decisive in establishing the image quality of the photographic pictures.

After a suitable pretreatment of the resin surface, the photographic coatings are applied on the surface of the resin layer either directly or after a previous application of an adhesion promoting or producing intermediate layer. These photographic layers are preferably layers of the type that have been known in connection with the concepts of silver salt photography, whether to produce either black-and-white pictures or color pictures. Silver salt photography concepts comprise not only photographic coatings, which contain inorganic silver salts and are developed predominantly wet with so-called developing solutions or pastes, but also photographic coatings which contain organic silver compounds and are developed predominantly dry, for instance, by the effect of heat.

According to DE-OS No. 30 22 451 or DE-OS No. 30 22 709, resin coatings hardened by electron radiation are produced by the application of a flowable mixture on the surface of a paper or on another base support by distributing the mixture thereon evenly and subsequently under protective gas or another covering by solidifying it by means of energy-rich electron rays. The mixtures contain as determining components at least one substance with ethylenically unsaturated double bonds which have the ability to undergo a polymerizing reaction with one another if this is initiated by radiation.

Suitable substances with ethylenically unsaturated double bonds are vinyl compounds or vinylidene compounds. Preferably, the mixture should contain at least one substance which contains two or more double bonds. Additionally, however, non-reacting substances without double bonds also can be contained in the mixture to a limited extent.

Especially suitable components capable of reaction are those substances which contain acrylate groups or methacrylate groups. Also suitable for use as reactive mixture compounds are esters of maleic acid, fumaric acid, mesaconic acid, citraconic acid or itaconic acid, other derivatives of these acids, allyl compounds, as well as linear and cyclic dienes or trienes, respectively. Preferred esters of these acids are those that are derived from multivalent alcohols. Examples are hexanediol diacrylate, trimethylol propane triacrylate, polyester acrylate, polyurethane acrylate, polyether acrylate, polyepoxy acrylate, alkyd resin acrylate, or the methacrylates corresponding to these acrylates. The flow characteristics of hardenable mixtures are adjusted by mixing components having a high molecular weight with components having a lower molecular weight. The hardness and flexibility of the hardened layers is determined by the proportion of double bonds to the molecule size present in the starting material and can be varied over a wide range by mixing of different substances with one another.

To be sure, layers hardened with electron radiation have many advantages when compared with polyolefin layers, but heretofore their usefulness has been seriously hampered by certain disadvantages. In spite of the great breadth of variation in the composition of radiation-hardened coatings, up until now coatings could not be produced which exhibit equally good behavior in all photographic process solutions. Rather, it was found that the layers hardened with electron rays behave differently with respect to different process solutions. Commercial color developer preparations have the disadvantage of a following oxygen effect that leads to a yellowish discoloration of the surface of the radiation-hardened layer. Although this coloration typically is slight, it is clearly visible and cannot be prevented, either by the shortstop bath or fixing bath or by thorough washing. Discoloration occurs especially in connection with the use of such photographic developing solutions which contain an aromatic amine derivative, such as a derivative of phenylene diamine, toluidine, and others. Consequently, the use of papers or films with radiation-hardened coatings has been restricted up until now to such processes in which other chemicals are used for developing the picture, for instance hydrochinone, or in which the picture is developed dry.

The described discoloration of the surface was observed first on coatings which had been produced from acrylic acid esters. Use of methacrylic acid esters or allyl compounds in place of the more widely used acrylic acid esters also was found to be unsatisfactory. All layers were clearly stained after treatment with certain commercial developing solutions which contained aromatic amine derivatives. The measured change of density was predominantly between 0.03 and 0.1, but greater changes also occurred.

THE SUMMARY OF THE INVENTION

It is therefore an object of the present invention to provide a photographic base material which is coated with at least one radiation-hardened layer, which does not have the described disadvantages, and which not only shows high resistance in connection with thermally developed pictures but which also shows no visible tendency to yellow staining even after treatment with photographic developing solutions or developing pastes of any kind. The concept of there being no visible tendency to yellow staining is defined as occurring when the determination of the optical density according to DIN 4512, as measured with yellow filter over white background, shows changes which are smaller than 0.03. The measurement is carried out first on the freshly hardened coatings, and afterwards it is repeated after bath treatment and four days under the influence of air. The difference between these two measured values characterizes the discoloration.

This object of the present invention is achieved by formulating the coating material so that it contains, before hardening, at least one unsaturated monomeric, oligomeric or polymeric hydroxyfunctional substance and so that the molal concentration of the hydroxyl groups is equal to or greater than 2.

DESCRIPTION OF THE PREFERRED EMBODIMENTS

Coating materials according to this invention include at least one unsaturated hydroxyfunctional substance, and the positions of the hydroxy group that are preferred with respect to developer staining, as defined in the invention, are a $\beta$ or a $\gamma$ position relative to the ester group or ether group. Correspondingly, allyl compounds have proved to be just as ineffective as allyl alcohol/styrol copolymers or vinyl alcohol copolymers.

Effective and suitable unsaturated hydroxyfunctional substances include, for instance, hydroxy ethyl acrylate, hydroxy propyl acrylate, glycerin diacrylate, trimethyl propane diacrylate, pentaerythritol triacrylate, pentaerythritol diacrylate, incompletely esterified sugar acrylates as well as polyester acrylates, polyether acrylates, epoxy resin acrylates or polyurethane acrylates, each one having free hydroxy groups, as well as the methacrylates corresponding to the acrylates mentioned here.

Other suitable unsaturated hydroxyfunctional substances include hydroxy-containing allyl ethers or multivalent alcohols, for instance, pentaerythritol triallyl ether, glycerin diallyl ether and other substances having a similar structure. Also, in connection with allyl ethers, an hydroxy molality greater than 2 is required in order to obtain layers which do not show any visible staining with a color developer.

Since the introduction of hydroxy-containing compounds in the form of a polyvinyl alcohol copolymer, an allyl alcohol copolymer, or glycerin diacetate had led to increased staining, and also since allyl alcohol as a mixture component was not suited to show any positive effect, it was surprising that other unsaturated hydroxyl compounds could suppress developer staining. It was especially surprising that single unsaturated hydroxyl compounds, such as hydroxy propyl acrylate, hydroxy butyl acrylate, hydroxy ethyl methacrylate, hydroxy ethyl allyl ether or glycolic acid allyl ester belong to the compounds which, unlike allyl alcohol, are usable in accordance with the invention. When it is desired to proceed with a co-use of such single unsaturated hydroxyfunctional acrylates, methacrylates, allyl esters or allyl ethers, attention must merely be given so that the co-use of a corresponding quantity of an at least triple unsaturated compound (for instance, trimethylol propane triacrylate or others) there are obtained non-stocking coatings because otherwise the softening effect of single unsaturated compounds becomes too much of a factor.

Within the framework of the invention it is insignificant whether the layers hardened with electron radiation contain further additives as they are common in such photographic bases. Especially included in this regard are pigments of any kind, as well as pigment dispersing agents, coloring substances and other substances which favorably influence the the quality of the picture and which are known to the expert and are described, for instance, in DE-OS No. 30 22 451.

The coating layers as defined in the invention can be present on paper, precoated paper, film or different laminates. They can be produced in any desired manner according to one of the described procedures and can have different surface structures which vary from glossy to very dull. This includes symmetrical surface structures such as are described in German Pat. No. 2,515,261. An especially suitable process for the production of the coatings as defined in the invention is described in DE-OS No. 30 22 709.

When paper, coated paper or mat are used as a base for a coating as defined in the invention, typically the opposite side also must be coated with waterproofing material. This can also be accomplished with a mixture as defined by the invention. But the opposite side can also be provided with a polyolefin coating or another waterproof coating. Also, several coatings of the same kind or of a different kind can be placed one over the other.

A photographic base that is provided with one or several coatings as defined in accordance with the present invention can be coated with photographic coatings in a well-known manner. After the usual pretreatment, the coated base is suitable for processing in all commercial photographic process solutions without the appearance of a bothersome discoloration, or it is suitable for thermal or other dry developing processes.

Although the hardenable coatings arranged on any support material are preferably hardened by means of electron rays, this is not a restricting element of the invention. Rather, the coatings can be hardened with any kind of radiation which provides sufficient energy for the triggering of the polymerization reaction on which the hardening is based. Consequently, X-rays or $\gamma$ rays are suitable, as are UV light or visible light, with the light sources typically requiring the addition of special initiators.

The characterizing element of the invention is solely the presence of a sufficient quantity of at least one hydroxyfunctional unsaturated compound, for instance, of a hydroxyfunctional ester of an unsaturated acid or of a hydroxyfunctional allyl ether or allyl ester in a layer that is hardenable by radiation.

The following examples serve to further explain and illustrate the invention. Here, Example 1 is to be seen as a comparison example which shows the multitude of the substances possible for radiation-hardened layers, which substances all show a more or less strong staining of the layer after the effect of a color developer. Compared to that, Examples 2, 3, and 4 show the effect of mixtures as defined by the invention, with further comparisons being built in each time by means of tests 2d, e, 1 and 3c and d where one falls below the limit of the hydroxyl molality of 2. This makes clear in a special manner the importance of this borderline value for the present invention.

The test data in Tables 1 to 4 are based on discolorations which were observed by using a commercial Kodak color developer. Other developers result in other values for the discoloration, but they showed the same tendency and confirmed that preferably the hydroxyl molality should not fall below 2.

A slight influence of the energy dose used for achieving the hardening result is also illustrated. But, the basic tendency of the invention is not changed, and the borderline molality value of 2 is still apparent, whether the dose capacities are 50 or 60 J/g or 40 J/g in order to achieve a coating that is optimally hardened.

EXAMPLE 1 (COMPARATIVE EXAMPLE)

Different samples of a paper coated with polyethylene on both sides were coated on one side each time with approximately 20 g/m$^2$ of a well-known radiation-hardenable substance or mixture according to Table 1. The hardenable coating was subsequently hardened each time under nitrogen by means of electron radiation with an energy dose of 40 J/g.

Subsequently, the hardened coatings were treated with a commercial photographic developer for color paper and were washed, and the samples were then stored at room temperature for four days with the admission of air. The discoloration of the layer occurring here was determined as a change of the optical density according to DIN 4512, such being listed in the last column of the Table.

Table 1 comprises all hardenable substances described in examples up to now or used in practice as well as examples of a selection of other substances from the multitude of investigated substances. The test results show that, after hardening, all of the substances have the tendency to stain visibly in connection with the color developer, with methacrylates showing greater staining tendencies than corresponding acrylates or allyl compounds.

Table 1 does not include tests with the addition of alkyl acrylates, alkyl methacrylates or glycidyl compounds, for instance, allyl glycidyl ether and others. These compounds were shown in comparison tests to always increased developer staining, which increases are proportional to the length of the alkyl group, as well as being proportional to the quantity used.

TABLE 1

Composition of the radiation-hardenable coating materials pertaining to Example 1 and discoloration by color developer measured on the hardened layers.

| Sample | Type of coating | OH molality of coating | Discoloration by developer |
|---|---|---|---|
| 1a | butane diol diacrylate (BUDA) | 0 | 0.045 |
| 1b | hexane diol diacrylate (HDDA) | 0 | 0.05 |
| 1c | trimethylol propane triacrylate (TMPTA) | 0 | 0.045 |
| 1d | trimethylene glycol diacrylate | 0 | 0.05 |
| 1e | tetraethylene glycol diacrylate (TEGDA) | 0 | 0.045 |
| 1f | tripropylene glycol diacrylate (TPGDA) | 0 | 0.055 |
| 1g | neopentyl glycol diacrylate (NPGDA) | 0 | 0.05 |
| 1h | poly (butane diol) diacrylate | 0 | 0.06 |
| 1i | hexane diol dimethacrylate | 0 | 0.065 |
| 1k | polyester tetraacrylate (M = approx. 1,000) | 0.7 | 0.06 |
| 1l | triacrylate of oxypropylized glycerin | 1.5 | 0.04 |
| 1m | bisphenol A-bis(ethoxy acrylate) | 0 | 0.08 |
| 1n | polyurethane diacrylate (M = approx. 4000) | 0.7 | 0.09 |
| 1o | neopentyl glycol dimethacrylate | 0 | 0.055 |
| 1p | polyethylene glycol dimethacrylate | 0 | 0.08 |
| 1q | 50% trimethylol glycol propane triacrylate<br>50% diethylene glycol diacrylate | 0 | 0.05 |
| 1r | 80% trimethylol propane triacrylate<br>20% styrol/ethyl acrylate copolymer | 0 | 0.055 |
| 1s | diallyl fumarate | 0 | 0.06 |
| 1t | 70% trimethylol propane tiacrylate<br>30% styrol/allyl alcohol copolymer | 0.9 | 0.07 |
| 1u | 45% TGPDA<br>45% TMPTA<br>10% allyl alcohol | 1.7 | 0.1 |
| 1v | 39% TPGDA<br>45% TMPTA<br>22% allyl alcohol | 3.8 | 0.14 |

EXAMPLE 2

As in Example 1, samples of a paper coated with polyethylene were coated on one side each time with approximately 20 g/m$^2$ of radiation-hardenable mixtures. Such mixtures contained pentaerythritol triacrylate as the characterizing component. The coatings were hardened as in Example 1 and subsequently subjected to the staining test with the color developer solution described in Example 1. The relevant data are compiled in Table 2.

TABLE 2

Compilation of radiation-hardenable coating materials pertaining to Example 2 as defined by the invention and of the discoloration by color developer measured on the hardened layers.

| Sample | Type of coating | OH molality of coating | Discoloration by developer |
|---|---|---|---|
| 2a | pentaerythritol triacrylate | 3.4 | 0.01 |
| 2b | 80% pentaerythritol triacrylate<br>20% trimethylol propane triacrylate | 2.7 | 0.02 |
| 2c | 60% pentaerythritol triacrylate<br>40% trimethylol propane | 2 | 0.025 |

TABLE 2-continued

Compilation of radiation-hardenable coating materials pertaining to Example 2 as defined by the invention and of the discoloration by color developer measured on the hardened layers.

| Sample | Type of coating | OH molality of coating | Discoloration by developer |
|---|---|---|---|
| | triacrylate | | |
| 2d | 45% pentaerythritol triacrylate<br>55% trimethylol propane triacrylate | 1.5 | 0.033 |
| 2e | 30% pentaerythritol triacrylate<br>70% trimethylol propane triacrylate | 1 | 0.04 |
| 2f | 60% pentaerythritol triacrylate<br>40% tetrapropylene glycol diacrylate | 2 | 0.027 |
| 2g | 50% polyester tetraacrylate<br>50% pentaerythritol triacrylate | 2 | 0.026 |
| 2h | 50% triacrylate of oxypropylized glycerin<br>50% pentaerythritol triacrylate | 2.4 | 0.02 |
| 2i | 70% pentaerythritol triacrylate<br>30% hexane diol diacrylate | 2.3 | 0.02 |
| 2k | 70% pentaerythritol triacrylate<br>30% tetraethylene glycol diacrylate | 2.3 | 0.018 |
| 2l | 53% pentaerythritol triacrylate<br>47% tetraethylene glycol diacrylate | 1.8 | 0.3 |
| 2m | 70% pentaerythritol triacrylate<br>10% tetraacrylate<br>20% styrol/ethyl acrylate copolymer | 2.3<br>penta-erythritol | 0.02 |

EXAMPLE 3

As in Example 1, samples of a paper coated with polyethylene were coated on one side each time with approximately 20 g/m$^2$ of radiation-hardenable mixtures. Such mixtures contained hydroxyl ethyl acrylate as the characterizing component. The coatings were hardened as in Example 1 and subsequently subjected to the staining test with color developer solution described in Example 1. The relevant data are compiled in Table 3.

TABLE 3

Compilation of radiation-hardenable coating materials pertaining to Example 3 and of the discoloration by color developer measured on the hardened layers.

| Sample | Type of coating | OH molality of coating | Discoloration by developer |
|---|---|---|---|
| 3a | 60% trimethylol propane triacrylate<br>40% hydroxy ethyl acrylate | 3.4 | 0.009 |
| 3b | 70% trimethylol propane triacrylate<br>30% hydroxy ethyl acrylate | 2.6 | 0.02 |
| 3c | 80% trimethylol propane triacrylate<br>20% hydroxy ethyl acrylate | 1.7 | 0.03 |
| 3d | 90% trimethylol propane triacrylate<br>10% hydroxy ethyl acrylate | 0.9 | 0.033 |
| 3e | 50% polyester tetraacrylate<br>50% hydroxy ethyl acrylate | 4.7 (approx.) | 0.005 |
| 3f | 40% polyester tetraacrylate<br>40% triacrylate of oxypropylized glycerin<br>20% hydroxy ethyl acrylate | 2.6 (approx.) | 0.027 |
| 3g | 40% triacrylate of oxypropylized glycerin<br>40% pentaerythritol triacrylate<br>20% hydroxy ethyl acrylate | 4.3 | 0.01 |
| 3h | 80% pentaerythritol triacrylate<br>20% hydroxy ethyl acrylate | 4.4 | 0.008 |
| 3i | 65% pentaerythritol triacrylate<br>35% hydroxy ethyl acrylate | 5.2 | 0.005 |
| 3k | 50% pentaerythritol triacrylate<br>50% hydroxy ethyl acrylate | 6 | 0.0 |
| 3i | 50% trimethylol propane triacrylate<br>30% hydroxy ethyl acrylate<br>20% styrol/ethyl acrylate copolymer | 2.6 | 0.21 |

EXAMPLE 4

As in Example 1, samples of a paper coated with polyethylene were coated on one side each time with approximately 20 g/m$^2$ of radiation-hardenable mixtures. Such mixtures contained different hydroxyl compounds besides other hardenable components. The coatings were hardened as in Example 1 and subsequently subjected to the staining test with color developer solution described in Example 1. The relevant data are compiled in Table 4.

TABLE 4

Compilation of radiation-hardenable coating materials pertaining to Example 4 and of the discoloration by color developer measured on the hardened layers.

| Sample | Type of coating | OH molality of coating | Discoloration by developer |
|---|---|---|---|
| 4a | 50% trimethylol propane triacrylate<br>20% triethylene glycol diacrylate<br>30% hydroxy ethyl acrylate | 2.6 | 0.02 |
| 4b | 40% triacrylate of oxypropylized glycerin<br>24% hexane diol diacrylate<br>36% glycerin diacrylate | 2.6 (approx.) | 0.02 |
| 4c | 48% triethylene glycol diacrylate<br>30% pentaerythritol triacrylate<br>22% hydroxy ethyl methacrylate | 2.7 | 0.017 |
| 4d | 65% pentaerythritol tetraacrylate<br>35% 2-hydroxypropyl acrylate | 2.7 | 0.019 |
| 4e | bis(2-hydroxypropoxy acrylate) of bisphenol-A | 2 | 0.029 |
| 4f | 40% tripropylene glycol | 2.3 | 0.025 |

TABLE 4-continued

Compilation of radiation-hardenable coating materials pertaining to Example 4 and of the discoloration by color developer measured on the hardened layers.

| Sample | Type of coating | OH molality of coating | Discoloration by developer |
|---|---|---|---|
| | diacrylate<br>60% pentaerythritol triallyl ether | | |
| 4g | 20% tripropylene glycol diacrylate<br>80% pentaerythritol triallyl ether | 3.1 | 0.02 |
| 4h | 70% pentaerythritol triallyl ether<br>30% hydroxy ethyl acrylate | 4.8 | 0.01 |
| 4i | 20% triethylene glycol diacrylate<br>80% triallyl citrate | 2.5 | 0.02 |
| 4k | 50% trimethylol propane triacrylate<br>50% hydroxy ethyl-β-carboxy ethyl acrylate | 2.6 | 0.022 |

What we claim is:

1. A photographic base material which contains on at least one side thereof a coating whose binder component is produced predominantly from unsaturated compounds and which has been hardened by means of ionizing radiation, wherein the coating, before said hardening thereof, comprises an unhardened coating composition containing at least one unsaturated hydroxyfunctional substance that is an ether or ester selected from the group consisting of monomeric, oligomeric and polymeric ethers and monomeric, oligomeric and polymeric esters, said hardened coating composition containing hydroxyl groups at a molal concentration that is equal to or greater than 2, and wherein said unhardened coating composition contains a compound having at least three carbon-to-carbon double bonds.

2. The photographic base material as defined in claim 1, wherein the hydroxyfunctional substance contains at least one hydroxyl group which is on a carbon atom in β position or γ position relative to an ester group or ether group.

3. The photographic base material as defined in claim 1, wherein the hydroxyfunctional substance includes at least one carbon-to-carbon double bond and is selected from the group consisting of a hydroxyalkyl ester of an unsaturated acid, an allyl ester of a hydroxy acid, and a hydroxyalkylallyl ether.

4. The photographic base material as defined in claim 3, wherein the hydroxyfunctional substance is selected from the group consisting of an ester of an acrylic acid, an ester of a methacrylic acid and an ester of a bivalent or multivalent alcohol.

5. A photographic base material which contains on at least one side thereof a coating whose binder component is produced predominantly from unsaturated compounds and which has been hardened by means of energy supplying radiation, wherein the coating, before said energy hardening thereof, comprises an unhardened coating composition containing at least one unsaturated hydroxyfunctional substance that is an ether or ester selected from the group consisting of monomeric, oligomeric and polymeric ethers and monomeric, oligomeric and polymeric esters, said unhardened coating composition containing hydroxyl groups at a molal concentration that is equal to or greater than 2;

wherein the hydroxyfunctional substance includes at least one carbon-to-carbon double bond and is a hydroxyalkylallyl ether that is an allyl ether of a bivalent or multivalent alcohol.

6. A photographic base material which contains on at least one side thereof a coating whose binder component is produced predominantly from unsaturated compounds and which has been hardened by means of energy supplying radiation, wherein the coating, before said energy hardening thereof, comprises an unhardened coating composition containing at least one unsaturated hydroxyfunctional substance that is an ether or ester selected from the group consisting of monomeric, oligomeric and polymeric ethers and monomeric, oligomeric and polymeric esters, said unhardened coating composition containing hydroxyl groups at a molal concentration that is equal to or greater than 2;

wherein the hydroxyfunctional substance includes at least one carbon-to-carbon double bond and is an allyl ester of a hydroxy acid.

7. The photographic base material as defined in claim 1, wherein the molal concentration of the hydroxyl groups is equal to or larger than 2.5.

8. The photographic base material as defined in claim 7, wherein the hydroxyl group is on a carbon atom in β position or γ position relative to said ester group or ether.

9. The photographic base material as defined in claim 1, wherein the hydroxyfunctional substance is a derivative of a glycol.

10. The photographic base naterial as defined in claim 7, wherein the hydroxyfunctional substance is a derivative of glycol.

11. The photographic base material as defined in claim 1, wherein the hydroxyfunctional substance is a derivative of glycerin.

12. The photographic base material as defined in claim 7, wherein the hydroxyfunctional substance is a derivative of glycerin.

13. The photographic base material as defined in claim 1, wherein the hydroxyfunctional substance is a derivative of sorbitol or pentaerythritol.

14. The photographic base material as defined in claim 7, wherein the hydroxyfunctional substance is a derivative of sorbitol or of pentaerythritol.

15. The photographic base material as defined in claim 2, wherein the hydroxyfunctional substance includes at least two carbon-to-carbon double bonds.

16. The photographic base material as defined in claim 8, wherein the hydroxyfunctional substance includes at least two carbon-to-carbon double bonds.

17. The photographic base material as defined in claim 2, wherein the hydroxyfunctional substance is a single unsaturated compound.

18. The photographic base material as defined in claim 8, wherein the hydroxyfunctional substance is a single unsaturated compound.

19. The photographic base material as defined in claim 2, wherein the hydroxyfunctional substance is a mixture of single unsaturated and multiple unsaturated compounds.

20. The photographic base material as defined in claim 8, wherein the hydroxyfunctional substance is a mixture of single unsaturated and multiple unsaturated compounds.

21. The photographic base material as defined in claim 1, wherein the coating material contains a colorant selected from the group consisting of white pigment, coloring substance, color pigment, and combinations thereof.

22. The photographic base material as defined in claim 7, wherein the coating material contains a colorant selected from the group consisting of white pigment, coloring substance, color pigment, and combinations thereof.

23. The photographic base material as defined in claim 21, wherein the coating material contains an optical brightener.

24. The photographic base material as defined in claim 22, wherein the coating material contains an optical brightener.

* * * * *

UNITED STATES PATENT AND TRADEMARK OFFICE

CERTIFICATE OF CORRECTION

PATENT NO. : 4,663,236

DATED : May 5, 1987

INVENTOR(S) : Reiner Anthonsen et al

It is certified that error appears in the above-identified patent and that said Letters Patent is hereby corrected as shown below:

Column 7, lines 37-40, in Table 2, the entry for Sample 2m in the column entitled "Type of coating" should read —70% pentaerythritol triacrylate
10% pentaerythritol tetraacrylate
20% styrol/ethyl acrylate copolymer-- and for Sample 2m at the bottom of the column entitled "OH molality of coating", the word "pentaerythritol" should be deleted.

Column 9, line 35, delete "hardened" and insert --unhardened—.

Signed and Sealed this

Twenty-seventh Day of October, 1987

*Attest:*

DONALD J. QUIGG

*Attesting Officer*

*Commissioner of Patents and Trademarks*